US010226102B2

(12) United States Patent
Santos et al.

(10) Patent No.: US 10,226,102 B2
(45) Date of Patent: Mar. 12, 2019

(54) SOLE OF A SHOE

(71) Applicant: Columbia Insurance Company, Omaha, NE (US)

(72) Inventors: Kenneth Daniel Santos, Randolph, MA (US); Bud Clapsaddle, Andover, MA (US)

(73) Assignee: Columbia Insurance Company, Omaha, NE (US)

( * ) Notice: Subject to any disclaimer, the term of this patent is extended or adjusted under 35 U.S.C. 154(b) by 34 days.

(21) Appl. No.: 14/813,872

(22) Filed: Jul. 30, 2015

(65) Prior Publication Data

US 2017/0027282 A1 Feb. 2, 2017

(51) Int. Cl.

*A43B 13/36* (2006.01)
*A43B 3/24* (2006.01)
*A43B 5/00* (2006.01)

(52) U.S. Cl.

CPC ..... *A43B 13/36* (2013.01); *A43B 3/246* (2013.01); *A43B 5/008* (2013.01)

(58) Field of Classification Search

CPC ..... A43B 13/34; A43B 13/28; A43B 13/36; A43B 5/008; A43B 3/246

See application file for complete search history.

(56) References Cited

U.S. PATENT DOCUMENTS 1,041,185 A * 10/1912 Spitz ..... A43B 13/36 36/15
4,267,650 A * 5/1981 Bauer ..... A43B 13/36 36/101
5,317,822 A * 6/1994 Johnson ..... A43B 13/36 36/101
5,533,280 A * 7/1996 Halliday ..... A43B 3/246 36/100
6,065,228 A * 5/2000 Begey ..... A43B 5/0417 36/117.3
6,598,324 B1 * 7/2003 Tsuji ..... A43B 1/0081 36/100
2006/0021260 A1 * 2/2006 Kim ..... A43B 5/00 36/130
2006/0101669 A1 * 5/2006 Santos ..... A43B 3/24 36/77 R
2007/0227039 A1 * 10/2007 Chaney ..... A43B 5/08 36/15
2008/0196274 A1 * 8/2008 Gerber ..... A43C 15/161 36/100
2008/0222920 A1 * 9/2008 Rovida ..... A43B 13/36 36/100
2009/0126230 A1 * 5/2009 McDonald ..... A43B 1/0063 36/88
2010/0122473 A1 * 5/2010 Santos ..... A43B 13/36 36/100

(Continued)

*Primary Examiner* — Megan E Lynch
(74) *Attorney, Agent, or Firm* — IP Attorneys Group, LLC

(57) ABSTRACT

A bowling shoe sole fastening system of structures that allows a variety of outsoles to be attached to and detached from the midsole that improve the consistency of the flex of the show throughout a bowler's stride, which allow the bowling shoe to be adjusted to achieve consistent stopping and sliding characteristics over a variety of bowling lane conditions and maintain consistent performance in the flex of the shoe across cycles of attachment, detachment, and reattachment.

20 Claims, 7 Drawing Sheets

(56) References Cited

U.S. PATENT DOCUMENTS

| | | | | |
|---|---|---|---|---|
| 2011/0113653 | A1* | 5/2011 | Grimmeisen | A43B 3/246 36/134 |
| 2012/0227289 | A1* | 9/2012 | Beers | A43B 3/128 36/25 R |
| 2014/0310990 | A1* | 10/2014 | Su | A43B 5/08 36/103 |
| 2014/0325877 | A1* | 11/2014 | Santos | A43B 5/008 36/103 |
| 2015/0320142 | A1* | 11/2015 | Handelman | A43B 5/008 36/15 |

* cited by examiner

SOLE OF A SHOE

CROSS REFERENCE TO RELATED APPLICATIONS

None.

FIELD OF THE INVENTION

The present invention relates to soles for bowling shoes, and more particularly, to soles for bowling shoes having attachable and detachable outsoles, where the outsole and the midsole each comprise one or more structures that securely attach the outsole to the midsole while the shoe is in use, but allow the outsole to be easily detached from the midsole when the shoe is not in use.

BACKGROUND OF THE INVENTION

Bowling shoes are often provided with different shoe soles for varying traction of the shoe sole on a surface of a bowling lane. In specific bowling lane conditions, the stopping and the sliding characteristics of a shoe can greatly enhance an ability of a bowler to stop his feet suddenly and abruptly. For example, when the bowler approaches a foul line to throw a ball, one foot usually performs the slide action and the other foot performs the traction action. A slide shoe for the slide action usually has a sole made with a low friction material, and a traction shoe has a sole with a high friction material for better traction. However, the optimal traction characteristics of each shoe will depend on several characteristics including each bowler's individual style and preference, on bowling surface conditions, and on whether the bowler is right- or left-handed.

A bowler limited to using conventional fixed sole bowling shoes would require many pairs of shoes to adjust to bowling lane conditions. Additionally, the ball and heel portions of the shoe outsoles often wear out prematurely due to increased stress exerted on these portions, rendering the whole shoe unusable to the bowler.

The prior art solves this problem by providing a shoe with an outsole that is designed to be attachable and detachable, allowing a bowler with a single pair of shoes to adjust to bowling lane conditions by selecting an appropriate outsole for the current bowling lane condition. The bowler simply selects an optimal outsole for use, attaches the outsole to the midsole, and the bowler is able to achieve optimal stopping and sliding characteristics for the current conditions, which aids the bowler in achieving consistent high performance. Many midsole and outsole fastener systems rely solely on a hook and pile fastener system to allow the outsole to be attached and detached.

Unfortunately, a fastener system that relies on a hook and pile system alone introduces undesirable variable shoe performance. Although a hook and pile fastener system enables attaching and detaching a variety of outsoles to a midsole, allowing a bowling shoe to be adapted to achieving consistent stopping and sliding characteristics over a range of bowling lane conditions, this solution creates variable shoe performance characteristics.

Unlike a fixed sole shoe, a shoe with an outsole and midsole attachment system that relies on a hook and pile fastener system does not flex uniformly throughout a bowler's stride. Generally, an outsole attached the hook and pile fastener system releases slightly over the course of the bowler's stride, because the hook portion of the system pulls away from the pile portion under shear stress caused by the bending of the sole. Thus, a system that relies on a hook and pile fastener system alone causes inconsistent flex in the shoe at key points in the bowler's stride, which in turn creates inconsistent bowler performance.

Worse, if a shearing force is applied to the leading edge of the outsole of the shoe, such as when a bowler drags a trailing foot on approach to the foul line, the outsole may partially peel away from the midsole of the shoe.

What is needed is an improved fastener system for attaching and detaching bowling shoe outsoles, which maintains the ability to attach and detach a variety of outsoles to the midsole, yet also increases consistency in the flex of the shoe as well as the attachment of the outsole to the midsole, throughout the bowler's stride.

SUMMARY OF THE INVENTION

Accordingly, it is an object of the present invention to provide a bowling shoe sole fastening system of structures that allows a variety of outsoles to be attached to and detached from the midsole, which allow the bowling shoe to be adjusted to achieve consistent stopping and sliding characteristics over a variety of bowling lane conditions.

It is a further object of the present invention to provide structures as a part of the bowling shoe sole fastening system of structures, which limit the leading edge of the outsole from peeling away from the midsole during use.

It is a further object of the present invention to provide structures as a part of the bowling shoe midsole and outsole fastener system, which allow the outsole and the midsole to be repeatedly and consistently attached and detached.

It is yet a further object of the present invention to provide structures as a part of the bowling shoe sole fastening system of structures, which improve the consistency of the flex of the shoe throughout a bowler's stride and allows the midsole to be attached and detached from a variety of outsoles.

It is yet a further object of the present invention to provide structures as a part of the bowling shoe sole fastening system of structures, which maintain consistent performance in the flex of the shoe across cycles of attachment, detachment, and reattachment.

These and other objects are achieved by providing novel and improved structures as a part of the bowling shoe sole fastening system of structures, which allow the outsole to be attached to and detached from the midsole as described below.

Accordingly, the present invention comprises one or more sets of structures of a bowling shoe sole that allow an outsole to be attached to and detached from a midsole, and which secure the outsole to the midsole in a manner that produces consistent performance in the flex of a bowling shoe.

Generally, the sole comprises a midsole and an outsole. The sole has a bottom surface that faces downward during standing wear of the shoe, and an upper surface that faces upward during standing wear of the shoe. The sole has a heel region, a forepart region, and a toe region. The sole has a sole perimeter. The sole perimeter has an outer edge. The outer edge has an upper outer edge, a bottom outer edge, and an outer edge thickness that may vary by location, such as in the heel region, the toe region, and other areas of the sole according to the design of the shoe. The outer edge of the sole perimeter may comprise a midsole outer edge, an outsole outer edge, or both, which may vary by location such as in the heel region, the toe region, and other areas of the sole. The sole may be characterized by a sole thickness that may vary by location, such as in the heel region, the toe region, and other areas of the sole.

Generally, the midsole has a midsole bottom surface that faces downward during standing wear of the shoe and an midsole upper surface that faces upward during standing wear of the shoe. The midsole has a midsole heel region, a midsole forepart region and, a midsole toe region. The midsole has a midsole perimeter. The midsole perimeter has a midsole outer edge. The midsole outer edge has a midsole upper outer edge, a midsole bottom outer edge, and a midsole outer edge thickness that may vary by location. The midsole may be characterized by a midsole thickness, and the midsole thickness may vary by location, such as in the midsole heel region, the midsole toe region, and other areas of the midsole according to the design of the shoe sole.

Generally, the outsole has an outsole bottom surface that faces downward during standing wear of the shoe and an outsole upper surface that faces upward during standing wear of the shoe. The outsole bottom surface contacts ground surfaces during normal wear of the shoe, and is characterized by a variety of ground contact surfaces designed to improve optimal stopping and sliding characteristics as known by those of skill in the art of bowling shoe design. The outsole has an outsole heel region, an outsole forepart region and, an outsole toe region. The outsole has an outsole perimeter. The outsole perimeter has an outsole outer edge. The outsole outer edge has an outsole upper outer edge, an outsole bottom outer edge, and outsole outer edge thickness that may vary by location. Advantageously, the outsole may comprise two parts corresponding to the outsole heel region, and the outsole forepart and outsole toe regions. The outsole may be characterized by an outsole thickness, and the outsole thickness may vary by location, such as in the outsole heel region, the outsole toe region, and other areas of the outsole according to the design of the shoe sole.

According to the present invention the outsole and midsole previously described further comprise structures that improve the attachment and detachment of outsoles to midsoles.

In one embodiment of the invention, the toe region of the sole comprises the midsole toe region and the outsole toe region, which further comprise a first set of structures that improve attachment and detachment of the outsole to the midsole. The toe region of the sole has a toe perimeter. The outsole toe region further comprises an outsole toe edge. The outsole toe edge further comprises an outsole toe ridge, with an outsole toe ridge length, extending along at least part of the outsole toe edge, and with an outsole toe ridge thickness. The midsole toe region further comprises a midsole toe edge, with a midsole toe edge length, shaped to complement the outsole toe ridge. When the outsole is attached to the midsole, the midsole toe edge and the outsole toe ridge limit movement between the outsole and the midsole in at least one direction.

In some preferred embodiments, the midsole outer edge of the midsole perimeter in the midsole toe region is a reduced by the outsole ridge thickness of the outsole toe region to form a reduced midsole outer edge, such that the outer edge of the sole perimeter is substantially smooth between the forepart region and the toe region of the sole. In further preferred embodiments, an angled seam is provided between the midsole outer edge and the outsole outer edge between the forepart region and the toe region. The angled transition seam is formed between the outsole and the midsole by providing a sloped outsole toe ridge end at each end of the outsole toe ridge and sloping corresponding portions of the midsole outer edge. In further preferred embodiments, the angled seam is provided at an oblique angle, and slopes upward from the forepart region towards the toe region. In further preferred embodiments, the oblique angle is between 30 and 60 degrees from the bottom surface of the sole.

In some embodiments of the first set of structures, the outsole toe ridge extends vertically to an outsole toe ridge height that is limited, such that a top of the outsole toe ridge is substantially flush with a top of the midsole toe edge when the outsole is attached to the midsole.

In other embodiments of the first set of structures, the midsole toe edge is formed with a notched edge, the notched edge having a notch depth extending away from the midsole toe edge and a notch height extending away from a bottom of the midsole. The outsole toe ridge extends vertically to the notch height. The outsole toe ridge may have a thickness that is less than, more than, or equal to the notch depth.

In still other embodiments of the first set of structures, the toe ridge further comprises an outsole shelf along at least part of the outsole toe ridge, the outsole shelf extending substantially perpendicular to the outsole toe ridge. The outsole shelf is configured to extend over the midsole toe edge when the outsole is attached to the midsole. Advantageously, the outsole shelf limits the leading edge of the outsole from peeling away from the midsole during use.

In a further preferred embodiment of the first set of structures with the outsole shelf, the midsole further comprises a midsole recess above the midsole toe edge and extending along at least part of the toe edge. The midsole recess is shaped to accommodate the outsole shelf, and wherein the outsole shelf terminates inside the midsole recess when the outsole is attached to the midsole. Advantageously, the midsole recess further secures the outsole shelf in place during use, further limits the leading edge of the outsole from peeling away from the midsole during use.

The toe ridge, shelf, toe edge, and recess may be formed from a material that is rigid, or advantageously the material may be semi-rigid such that these structures resist substantial deformation and yet retain some flexibility. When the outsole is attached to the midsole the structures substantially limit movement between the outsole and the midsole in at least one direction.

In another embodiment of the invention, the midsole and the outsole of a shoe further comprises a second set of structures that improve attachment and detachment of the outsole to the midsole. The second set of structures comprises complementary fastener areas, a midsole fastener area on the midsole bottom and an outsole fastener area on the outsole top, such that the midsole fastener area and the outsole fastener area may be attached and detached from each other. In such an embodiment, at least one of the group consisting of the midsole fastener area and the outsole fastener area further comprises a gap, such that when the outsole is attached to the midsole the gap remains unfastened. In some embodiments the complementary fastener areas may comprise a hook fastener area and a pile fastener area. Preferably, the hook fastener area is permanently attached to the midsole bottom surface and the pile fastener area is permanently attached to the outsole upper surface In a preferred embodiment of the second set of structures with a gap, the gap extends laterally from a left side outer edge of the sole to a right side outer edge of the sole.

In some embodiments the second set of structures further comprises a set of gaps in at least one of the group consisting of the midsole fastener area and the outsole fastener area. Each gap extends laterally from the right side of the sole to the left side of the sole. In yet a further preferred embodiment of the second set of structures, the set of gaps are located laterally across the sole covering an area or areas that experience high flex during use of the shoe, such as the part of the shoe that is beneath the phalanges and metatarsals of the foot when the shoe is worn.

In yet a further preferred embodiment of the second set of structures, there is a midsole fastener gap and an outsole fastener gap. Both gaps extend laterally from the right side of the sole to the left side of the sole. The midsole fastener gap further comprises a midsole groove. The midsole groove extends laterally from the right side of the sole to the left side of the sole. The outsole fastener gap further comprises an outsole protrusion. The outsole protrusion extends laterally from the right side of the sole to the left side of the sole. The outsole protrusion and the midsole groove are formed to be complementary such that protrusion fits into the groove when the outsole is attached to the midsole.

In another preferred embodiment of the second set of structures, there are a set of midsole grooves and a set of outsole protrusions. Each midsole groove extends laterally from the right side of the midsole to the left side of the midsole and corresponds to an outsole protrusion extending laterally from the right side of the outsole to the left side of the outsole. The set of outsole protrusions and the set of midsole grooves are configured to match, such that when the outsole is attached to the midsole each outsole protrusion in the set of outsole protrusions fits into a corresponding midsole groove in the set of midsole grooves. The location and spacing of the midsole groove and the outsole protrusion pairs may be specified to facilitate the flex of the shoe.

In some preferred embodiments the second set of structures comprises a midsole groove group and an outsole protrusion group. A midsole groove group is characterized by two or more midsole grooves with no spacing or minimal spacing between each midsole groove. An outsole protrusion group is characterized by two or more outsole protrusions with no spacing or minimal spacing between each outsole protrusion. An outsole protrusion group and a midsole protrusion group are configured to match, such that when the outsole is attached to the midsole each outsole protrusion in the outsole protrusion group fits into a corresponding midsole groove in midsole groove group. The location of corresponding midsole groove groups and outsole protrusion groups may be specified to facilitate the flex of the shoe, such as an area of the sole of the shoe that is beneath the phalanges and metatarsals of the foot when the shoe is worn.

In some preferred embodiments of the second set of structures, the protrusion is configured be a flexible joint. The flexible joint is characterized by having increased flexibility with respect to other parts of the outsole. The flexible joint may be formed into an arch, such that the arch fits into the midsole groove when the outsole is attached to the midsole. Flexibility of the arch may be specified by specifying the shape of the arch, the thickness of the arch, the material of the arch, or combinations thereof.

In a further preferred embodiment, the first and second sets of structures are used in combination to provide a system of structures that allow the midsole to be attached and detached from complementary outsoles, to adjust the stopping and sliding characteristics of a shoe, yet maintain consistent performance in the flex of the shoe across cycles of attachment, detachment, and reattachment of midsole to outsole.

Advantageously, in some preferred embodiments of the present invention, a left shoe and a right shoe each comprise a midsole forepart and a midsole heel part. The midsole forepart includes a midsole area from a toe of the shoe to a selected line in front of the midsole heel part. The midsole forepart has a peripheral shape, wherein the peripheral shape of the midsole foreparts of the left shoe and of the right shoe are substantially identical. The outsole comprises an outsole forepart and an outsole heel part. The outsole forepart has a peripheral shape, wherein the peripheral shape of the outsole forepart substantially matches the peripheral shapes of both the midsole foreparts of the left shoe and the right shoe, such that the outsole forepart may be mounted to the left shoe and to the right shoe.

Additional details and benefits of the present invention will be apparent based on reference to the following description and appended drawings.

DETAILED DESCRIPTION

Referring now to the figures in which identical elements are referenced identically throughout, a description of exemplary embodiments of the present invention will now be provided.

Figure 1A:
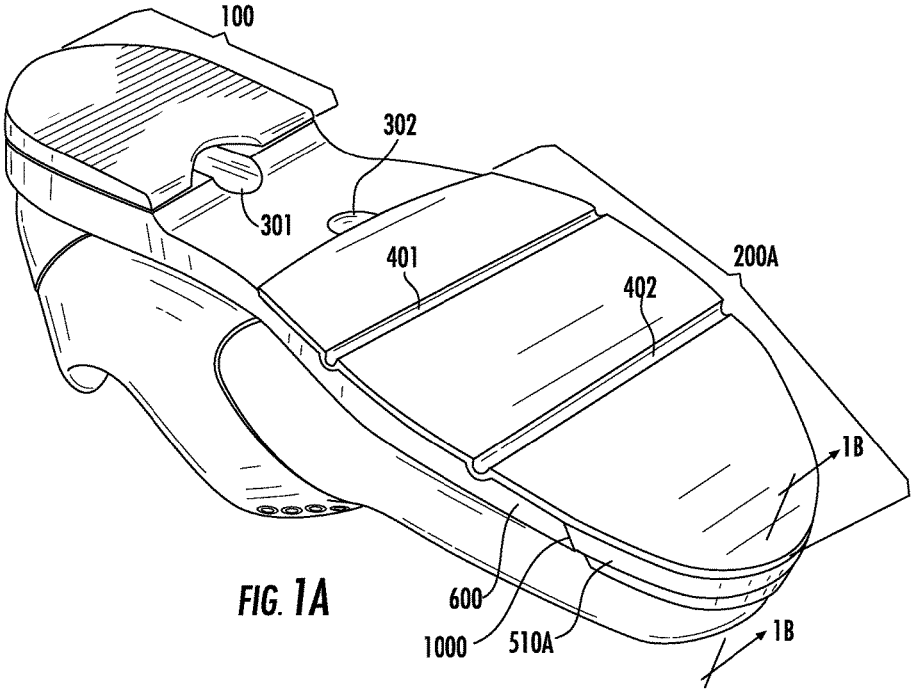
FIG. 1A is a view of a bowling shoe sole, showing the midsole and the outsole in an attached state, with the outsole configured to be attachable and detachable to the midsole.

Referring to FIG. 1A, a view of a bowling shoe sole is depicted, with a sole toe region, a sole forepart region, and a sole heel region. The midsole and an outsole are depicted in an attached state, with the outsole configured to be attachable and detachable to the midsole. The outsole is provided in two pieces, a first outsole portion 100 that comprises the outsole heel portion and a second outsole portion 200A that includes the outsole forepart region and the outsole toe region. Portions of two midsole finger channels are depicted, a first finger channel 301 extending through a portion of the midsole heel region, and a second finger channel 302 extending to a depth below an edge of the midsole fastener area. A first flexible joint 401 and a second flexible joint 402 are depicted, the joints extending laterally across the sole. An angled seam 1000 between one end of the outsole toe ridge 510A and the midsole outer edge 600 is also depicted. A portion of the toe region of the sole is identified as area 1B, and depicted in FIG. 1B.

Figure 1B:
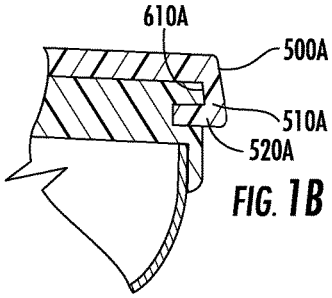
FIG. 1B is a cross section view of the toe of the bowling shoe sole, showing the outsole and the midsole in an attached state, depicting an outsole toe ridge and a outsole shelf, and depicting a midsole toe edge and a midsole recess.

Referring to FIG. 1B, a cross sectional area of the toe region of the sole is depicted with the midsole attached to the outsole. The outsole toe edge 500A is depicted, with the outsole toe ridge 510A, and an outsole shelf 520A. The midsole toe edge 610A is depicted, with a midsole recess. The outsole shelf is depicted as terminating within the midsole recess.

Figure 1C:
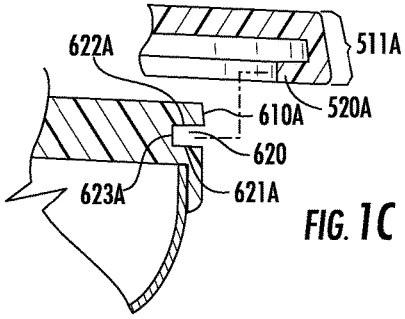
FIG. 1C is a cross section view of the toe of the bowling shoe sole, showing the outsole and the midsole in a detached state, depicting an outsole toe ridge and a outsole shelf, and depicting a midsole toe edge and a midsole recess.

Referring to FIG. 1C, a cross sectional area of the toe region of the sole is depicted, with the outsole detached from the midsole. The outsole toe ridge 511A is depicted. The midsole is depicted as having a midsole recess 620 above the midsole toe edge 610A. Although the midsole recess walls 621A and 622A are depicted as parallel, in some embodiments one or both of the midsole recess walls are slanted slightly, such that the distance between the midsole recess sidewalls is less as the two sidewalls approach the midsole recess end wall 623A. In such an embodiment, the outsole shelf 520A may also comprise a similar slant. Advantageously, the outsole shelf may be made from a material that is slightly compressible, and fitting the outsole shelf into the midsole recess results in a compression fit to further secure the outsole shelf within the midsole recess.

Figure 2A:
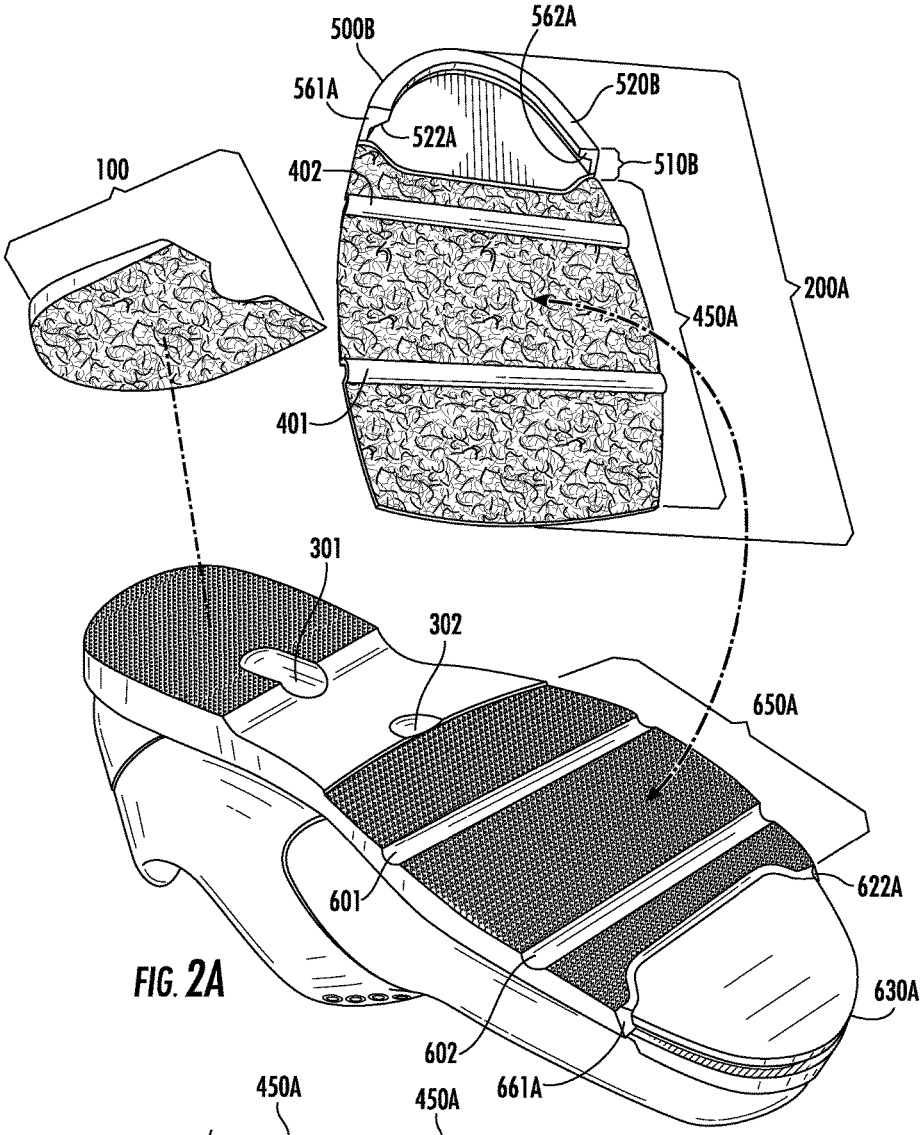
FIG. 2A is a view of the bowling shoe sole, showing the midsole of the shoe and the outsole forepart and the outsole heel in a detached state, with the outsole configured to be attachable and detachable to the midsole.

Referring to FIG. 2A, a view of a bowling shoe sole is depicted, with an outsole provided in two parts, a first outsole part 100 comprising an outsole heel portion and a second outsole part 200A comprising an outsole forepart portion and an outsole toe portion. Two midsole finger channels are depicted, a first finger channel 301 extending through a portion of the midsole heel region, and a second finger channel 302 extending to a depth below an edge of the midsole fastener area. In the forepart region of the second outsole part, an outsole attachment area 450A is depicted with a first outsole gap 401 and a second outsole gap 402, shown as flexible joints that extend laterally across the outsole. In the forepart region of the midsole, a midsole attachment area 650A is depicted with a first midsole attachment gap 601 and a second midsole attachment gap 602, shown as semi-circular grooves that extend laterally across the midsole. The outsole toe region is depicted as having an outsole toe edge 500B, and an outsole toe ridge 510B with an outsole shelf 520B. The outsole shelf is depicted with a slanted underside 522A that corresponds to a slanted midsole recess wall. The outsole toe ridge is depicted with sloped toe ridge ends 561A and 562A that correspond to sloping portions of the midsole outer edge 661A and 662A. The midsole toe region is depicted as having a reduced midsole outer edge 630A. The midsole toe edge further comprises a midsole recess.

Figure 2B:
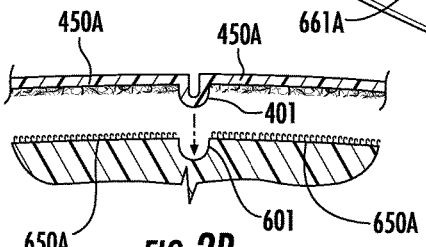
FIG. 2B is a cross section view of a part of the midsole forepart and the outsole forepart, depicting the midsole fastener area and the outsole fastener area with a midsole fastener gap and an outsole fastener gap. The midsole fastener gap is depicted with a midsole groove, the outsole fastener gap is depicted with an outsole protrusion, and the outsole protrusion is depicted as a flexible joint.

Referring to FIG. 2B, a cross sectional area of the midsole forepart and the outsole forepart is depicted, further comprising a hook fastener area 650A of the midsole, a pile fastener area 450A of the outsole. Each fastener area is depicted with a gap. The midsole fastener area gap 601 is depicted as a semi-circular groove, which provides enhanced flexibility and limits shear stress on the fastener areas caused by bending of the shoe. The outsole fastener gap 401 is depicted with a flexible joint. The flexible joint is formed in the shape of an arch, which provides enhanced flexibility and limits stress on the fastener areas caused by bending of the shoe. Advantageously, the semi-circular groove of the midsole and the flexible joint of the outsole are shaped to complement each other when the outsole is attached to the midsole. As depicted, the groove and flexible joint are allowed to flex independently as the shoe bends, and these areas are not secured directly to each other by the hook and pile fastener system.

Figure 3A:
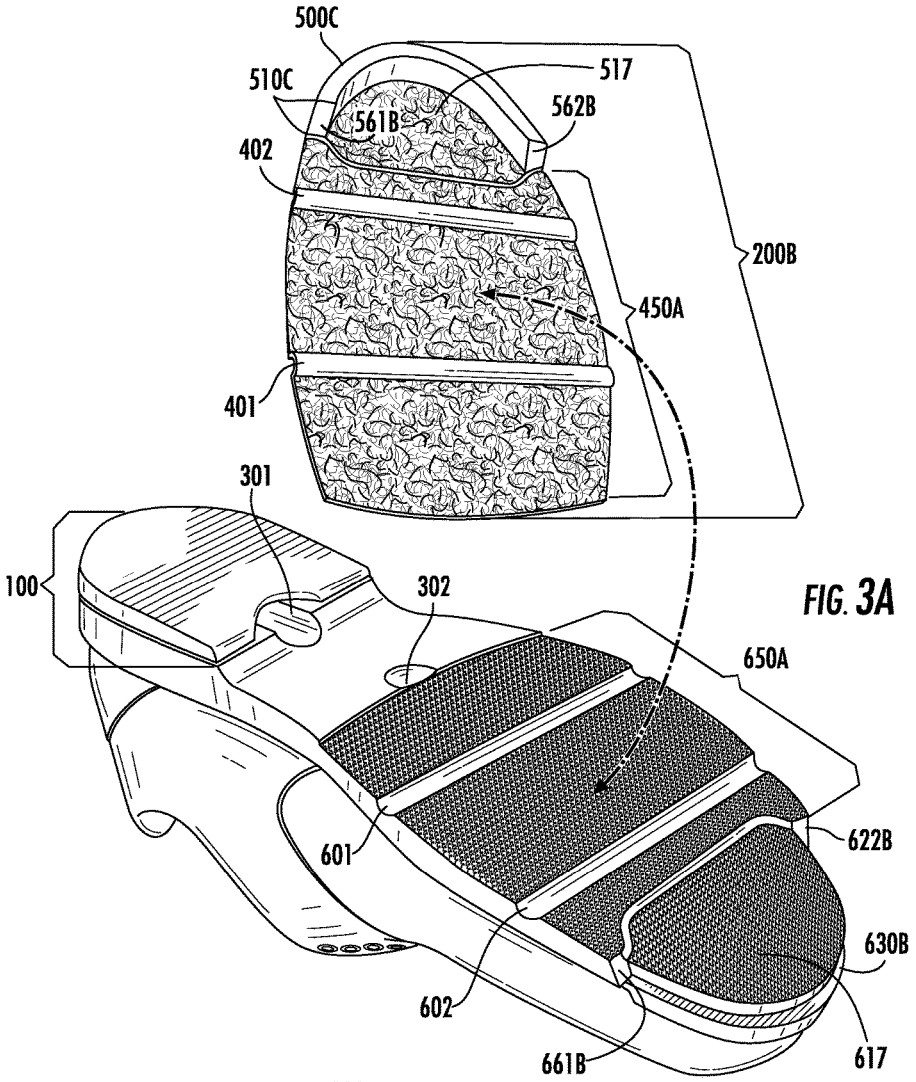
FIG. 3A is a view of the bowling shoe sole, showing the midsole of the shoe and the outsole of the shoe, where the forepart of the outsole is in a detached state and the heel of the outsole is in an attached state, with the outsole configured to be attachable and detachable to the midsole.

Referring to FIG. 3A, a view of a bowling shoe sole is depicted, with an outsole provided in two parts, a first outsole part 100 comprising an outsole heel portion and a second outsole part 200B comprising an outsole forepart portion and an outsole toe portion. The first outsole part is depicted as attached to the midsole of the shoe. Two midsole finger channels are also depicted. The first finger channel 301 is shown as extending through a portion of the midsole heel region, underneath a portion of the first outsole part. The second finger channel 302 is shown as extending to a depth below an edge of the midsole fastener area. In the forepart region of the second outsole part, an outsole attachment area 450A is depicted with a first outsole gap 401 and a second outsole gap 402 depicted as flexible joints that extend laterally across the outsole. In the forepart region of the midsole, a midsole attachment area 650A is depicted with a first midsole attachment gap 601 and a second midsole attachment gap 602, shown as semi-circular grooves that extend laterally across the midsole. The outsole toe region is depicted as having an outsole toe edge 500C with an outsole toe ridge 510C. The outsole toe ridge is depicted with sloped toe ridge ends 561B and 562B that correspond to sloping portions of the midsole outer edge 661B and 662B. The midsole toe region is depicted as having a reduced midsole outer edge 630B.

Figure 3B:
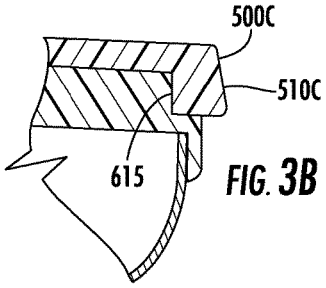
FIG. 3B is a cross section view of the toe of a bowling shoe sole, showing a cross section of the outsole and the midsole in an attached state, where the toe ridge is depicted without a shelf and the midsole toe edge is depicted with a notched edge.
Figure 3C:
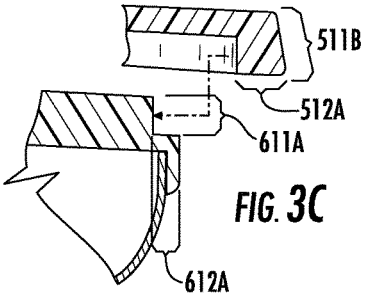
FIG. 3C is a cross section view of the toe of the bowling shoe sole, showing the outsole and the midsole in a detached state, depicting an outsole toe ridge, and depicting a midsole toe edge with a notched edge.

Referring to FIG. 3B and FIG. 3C, a cross sectional area of the toe region of the sole is depicted. In FIG. 3B the outsole is depicted as attached to the midsole and in FIG. 3C the outsole is depicted as detached from the midsole. The outsole toe edge 500C is depicted, with the outsole toe ridge 510C. The outsole toe ridge has an outsole toe ridge thickness 512A and an outsole toe ridge height 511B. The midsole toe edge is depicted, with a midsole notch 615. The midsole notch has a midsole notch depth 612A that is measured as a distance from the midsole edge. The midsole notch has a midsole notch height 611A that is measured as a distance from the midsole bottom. As depicted the midsole notch and outsole toe ridge are configured such that the outsole toe ridge extends to the midsole notch height, and the outsole toe ridge has a thickness greater than the midsole notch depth, such that the top of the outsole toe ridge seats against the top of the midsole notch but the outer edge of the outsole toe ridge extends beyond the midsole toe edge.

Figures 4A, 4B, 4C:
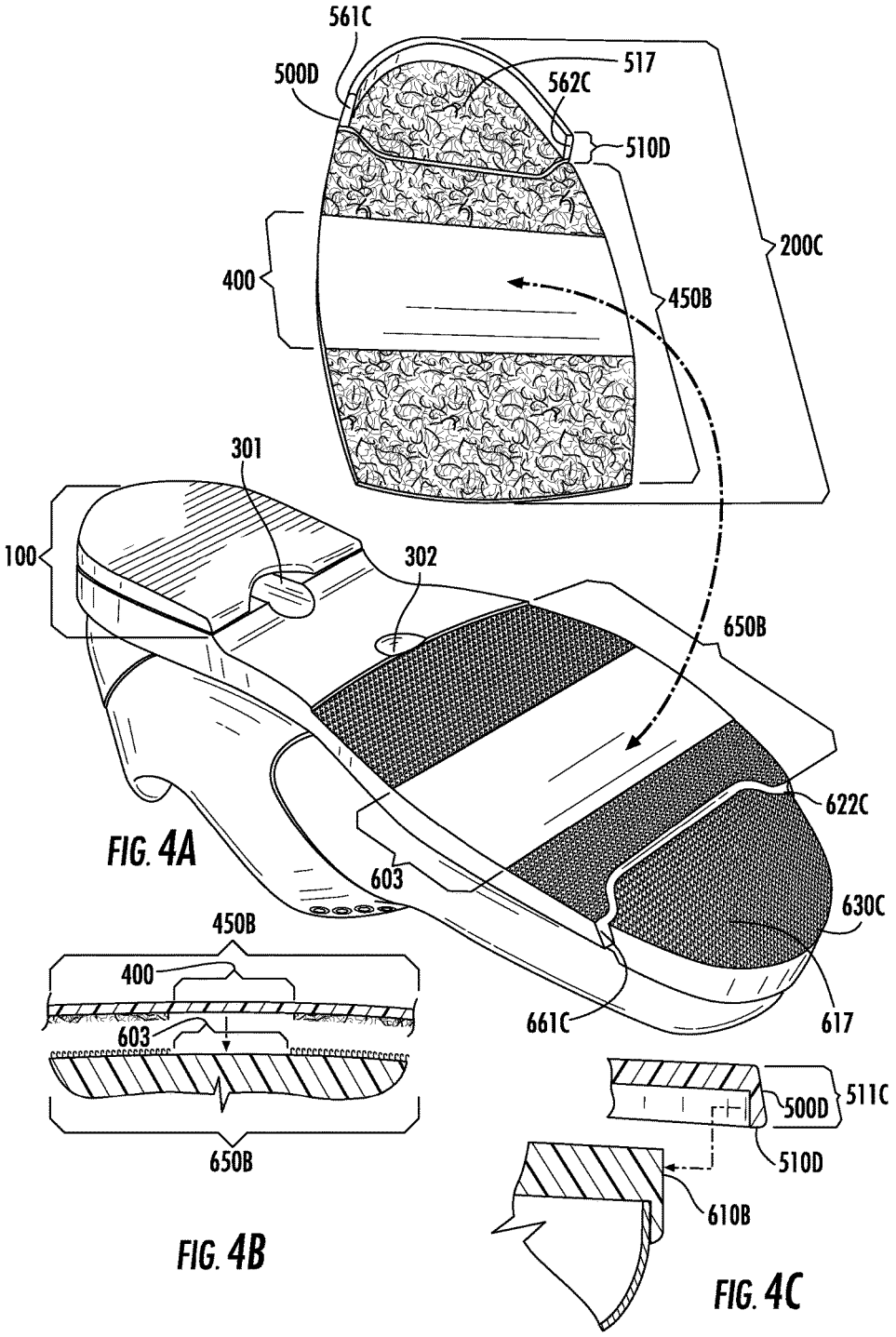
FIG. 4A is a view of the bowling shoe sole, showing the midsole of the shoe and the outsole of the shoe, where the forepart of the outsole is in a detached state and the heel of the outsole is in an attached state, with the outsole configured to be attachable and detachable to the midsole.
FIG. 4B is a cross section view of a part of the midsole forepart and the outsole forepart, depicting the midsole fastener area and the outsole fastener area with a midsole fastener gap and an outsole fastener gap.
FIG. 4C is a cross section view of the toe of the bowling shoe sole, showing the outsole and the midsole in a detached state, depicting an outsole toe ridge, and depicting a midsole toe edge.

Referring to FIG. 4A, a view of a bowling shoe sole is depicted, with an outsole provided in two parts, a first outsole part 100 comprising an outsole heel portion and a second outsole part 200C comprising an outsole forepart portion and an outsole toe portion. The first outsole part is depicted as attached to the midsole of the shoe. Two midsole finger channels are also depicted. The first finger channel 301 is shown as extending through a portion of the midsole heel region, underneath a portion of the first outsole part. The second finger channel 302 is shown as extending to a depth below an edge of the midsole fastener area. In the forepart region of the second outsole part, an outsole attachment area 450B is depicted with a flat outsole gap 400. In the forepart region of the midsole, the midsole attachment area 650B is depicted with a flat midsole gap. The outsole toe region is depicted as having an outsole toe edge 500D with an outsole toe ridge 510D. The outsole toe ridge 510D is depicted with sloped toe ridge ends 561C and 562C that correspond to sloping portions of the midsole outer edge 661C and 662C. The midsole toe region is depicted as having a reduced midsole outer edge 630C.

Referring to FIG. 4B, a cross sectional area of the midsole forepart and the outsole forepart is depicted, further comprising a hook fastener area of the midsole 650B, and a pile fastener area of the outsole 450B. Each fastener area is depicted with a flat gap. The midsole fastener area gap 603 is allowed to flex independently from the outsole fastener area gap 400, which provides enhanced flexibility for the shoe as a whole, and limits shear stress on the fastener areas caused by bending of the shoe.

Referring to FIG. 4C, a cross sectional area of the toe region of the sole is depicted. The outsole is depicted as detached from the midsole. The outsole toe edge 500D is depicted, with the outsole toe ridge 510D having an outsole toe ridge height 511C. The midsole toe edge 610B is depicted as flat, and the outsole toe ridge fits against the midsole toe edge when the outsole is attached to the midsole.

Figure 5A:
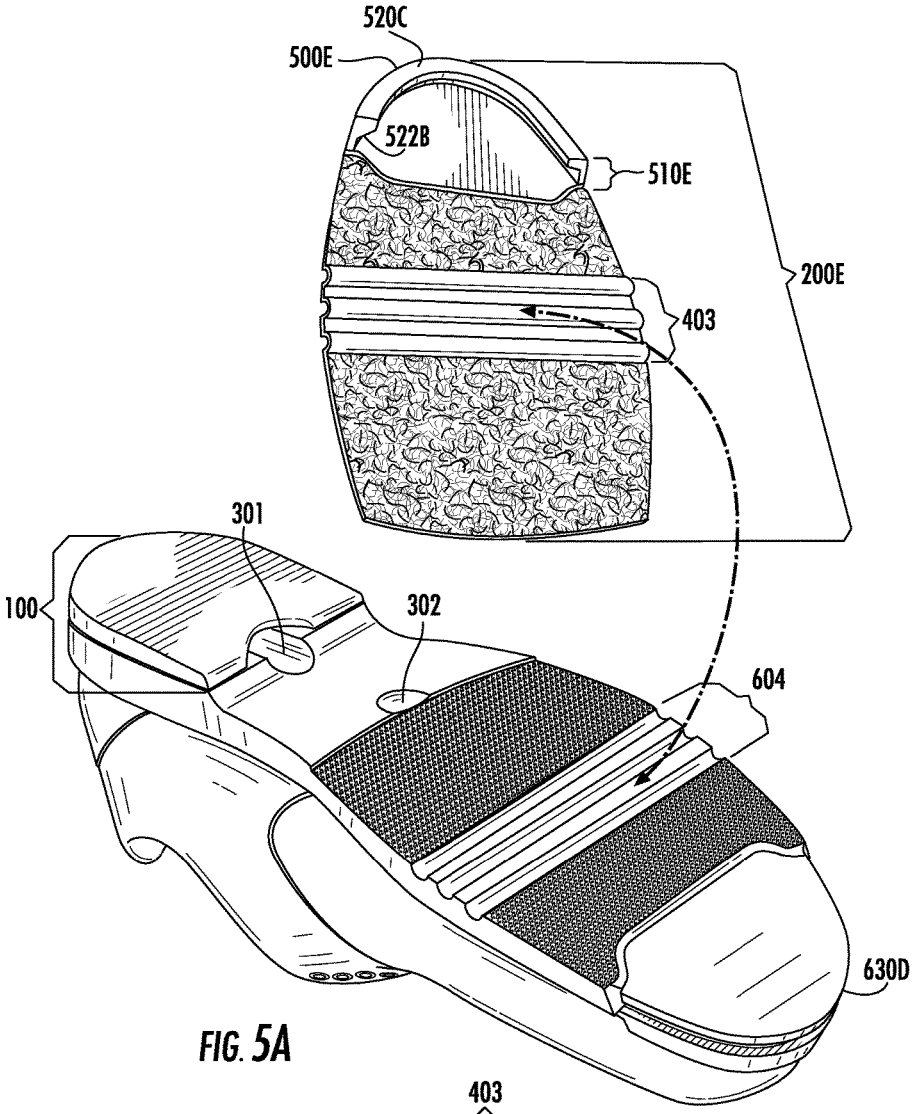
FIG. 5A is a view of the bowling shoe sole, showing the midsole of the shoe and the outsole of the shoe, where the forepart of the outsole is in a detached state and the heel of the outsole is in an attached state, with the outsole configured to be attachable and detachable to the midsole.

Referring to FIG. 5A, a view of a bowling shoe sole is depicted, with an outsole provided in two parts, a first outsole part 100 comprising an outsole heel portion and a second outsole part 200E comprising an outsole forepart portion and an outsole toe portion. Two midsole finger channels are depicted, a first finger channel 301 extending through a portion of the midsole heel region, and a second finger channel 302 extending to a depth below an edge of the midsole fastener area. In the forepart region of the second outsole part, an outsole fastener area is depicted with an outsole fastener area gap. The outsole fastener area gap comprises an outsole protrusion group 403, comprising three flexible joints that extend laterally across the outsole, each separated by a small flat gap. In the forepart region of the midsole, a midsole attachment area is depicted with a midsole attachment area gap. The midsole attachment area gap further comprises a midsole groove group 604, comprising three semi-circular grooves that extend laterally across the midsole, each separated by a small flat gap. The outsole toe region is depicted as having an outsole toe edge 500E, and outsole toe ridge 510E with an outsole shelf 520C. The outsole shelf 520C is depicted with a slanted underside 522B that corresponds to a slanted midsole recess sidewall. The outsole toe ridge 510E is depicted with sloped toe ridge ends that correspond to sloping portions of the midsole outer edge. The midsole toe region is depicted as having a reduced midsole outer edge 630D. The midsole toe edge further comprises a midsole recess.

Figure 5B:
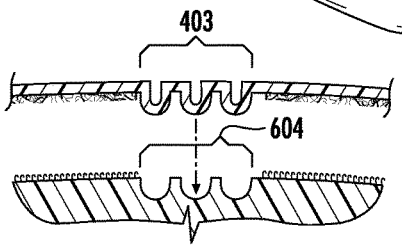
FIG. 5B is a cross section view of a part of the midsole forepart and the outsole forepart, depicting the midsole fastener area and the outsole fastener area with a midsole fastener gap and an outsole fastener gap. The midsole fastener gap is depicted with a midsole groove group, the outsole fastener gap is depicted with an outsole protrusion group, and each outsole protrusion is depicted as a flexible joint.

Referring to FIG. 5B, a cross sectional area of the midsole forepart and the outsole forepart is depicted, further comprising a hook fastener area of the midsole, a pile fastener area of the outsole. Each fastener area is depicted with a gap. The midsole fastener area gap is depicted as comprising a midsole groove group 604, with three semi-circular grooves that are each separated by a small flat gap. The outsole fastener gap is depicted with an outsole protrusion group 403, comprising three flexible joints. Each flexible joint is formed in the shape of an arch and is separated by a small flat gap. The outsole protrusion group 403 and the midsole groove group 604 provide enhanced flexibility and limits stress on the fastener areas caused by bending of the shoe. Advantageously, the semi-circular grooves of the midsole group and the flexible joints of the outsole protrusion group are shaped to complement each other when the outsole is attached to the midsole. As depicted, the midsole groove group 604 and outsole protrusion group 403 are allowed to flex independently as the shoe bends, and these areas are not secured directly to each other by the hook and pile fastener system.

Figure 6A:
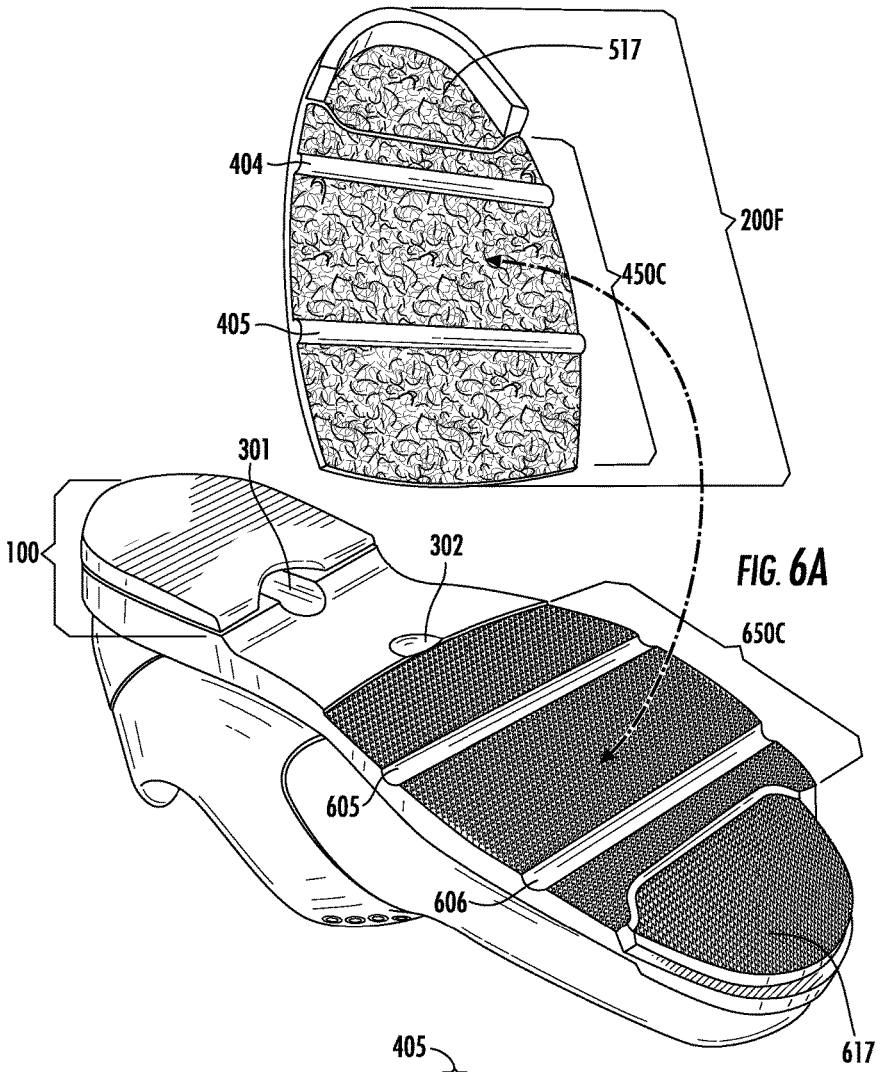
FIG. 6A is a view of the bowling shoe sole, showing the midsole of the shoe and the outsole of the shoe, where the forepart of the outsole is in a detached state and the heel of the outsole is in an attached state, with the outsole configured to be attachable and detachable to the midsole.
Figure 6B:
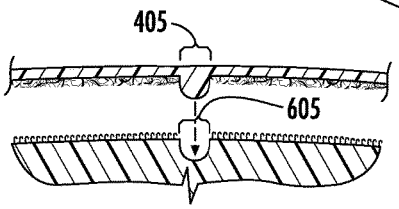
FIG. 6B is a cross section view of a part of the midsole forepart and the outsole forepart, depicting the midsole fastener area and the outsole fastener area with a midsole fastener gap and an outsole fastener gap. The midsole fastener gap is depicted with a midsole groove, and the outsole fastener gap is depicted with an outsole protrusion.

Referring to FIG. 6A, a view of a bowling shoe sole is depicted, with an outsole provided in two parts, a first outsole part 100 comprising an outsole heel portion and a second outsole part 200 comprising an outsole forepart portion and an outsole toe portion. The first outsole part is depicted as attached to the midsole of the shoe. Two midsole finger channels are also depicted. The first finger channel 301 is shown as extending through a portion of the midsole heel region, underneath a portion of the first outsole part. The second finger channel 302 is shown as extending to a depth below an edge of the midsole fastener area. In the forepart region of the second outsole part, an outsole attachment area 450C is depicted with a first outsole gap 404 and a second outsole gap 405 that are depicted as solid protrusions that extend laterally across the outsole. In the forepart region of the midsole, a midsole attachment area 650C is depicted with a first midsole attachment gap 605 and a second midsole attachment gap 606, shown as semi-circular grooves that extend laterally across the midsole. The outsole toe region is depicted as having an outsole toe edge and an outsole toe ridge. The outsole toe ridge is depicted with sloped toe ridge ends that correspond to sloping portions of the midsole outer edge. The midsole toe region is depicted as having a reduced midsole outer edge Referring to FIG. 6B, a cross sectional area of the midsole forepart and the outsole forepart is depicted, further comprising a hook fastener area of the midsole, a pile fastener area of the outsole. Each fastener area is depicted with a gap. The midsole fastener area gap 605 is depicted as a semicircular groove, which provides enhanced flexibility and limits shear stress on the fastener areas caused by bending of the shoe. The outsole fastener gap is depicted as an outsole protrusion 405. The outsole protrusion is formed in a shape that complements the midsole groove when the outsole is attached to the midsole. The gaps limit stress on the fastener areas caused by bending of the shoe. As depicted, the midsole groove and outsole protrusion are allowed to flex independently as the shoe bends, and these areas are not secured directly to each other by the hook and pile fastener system.

Figure 7A:
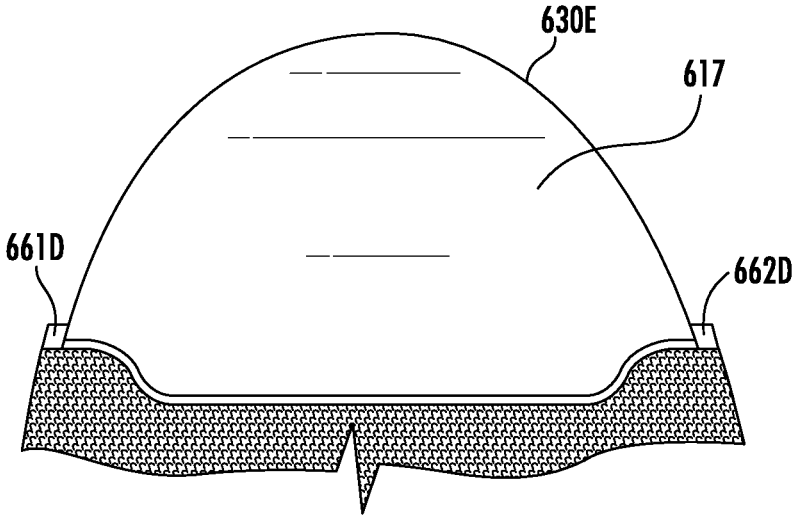
FIG. 7A is a partial view of a midsole bottom, depicting the midsole toe region and a portion of the midsole forepart region.
Figure 7B:
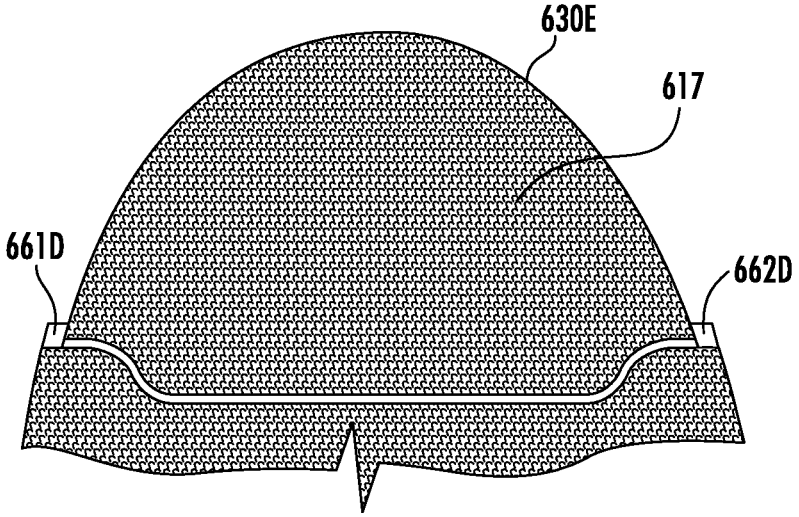
FIG. 7B is a partial view of a midsole bottom, depicting the midsole toe region and a portion of the midsole forepart region.

Referring to FIGS. 7A and 7B, the toe region of the midsole is depicted with a portion of the forepart region of the midsole. Bottom surface 617 is shown. The reduced midsole outer edge 630E is visible, and the outer edge of the forepart region is depicted with sloped ends 661D and 662D.

Referring to FIGS. 3A, 4A, 6A, and 7B, in some embodiments, a securing apparatus is used to fasten upper surface 517 of outsole toe region to bottom surface 617 of midsole toe region. Securing apparatus is any fastener or attachment mechanism. In one embodiment, the securing apparatus is a hook and pile system. In another embodiment, the securing apparatus is a rivet mechanism. In yet another embodiment, the securing apparatus is an adhesive such as tape. In yet another embodiment, the securing apparatus is a snap fastener. In yet another embodiment, the securing apparatus is a button fastener. In yet another embodiment, the securing apparatus is a latching mechanism. In yet another embodiment, the securing apparatus is a clamping mechanism. In preferred embodiments, the securing apparatus allows upper surface 517 of outsole toe region to be removably attached to button surface 617 of midsole toe region.

Although the invention has been described with reference to several embodiments with certain structures and configurations, these are not intended to exhaust all possible combinations or arrangements of features that are contemplated that are contemplated by the scope of the invention, and many other combinations or arrangements of features will be ascertainable to those of skill in the art after reviewing the invention disclosure.

What is claimed is:

1. A sole of a shoe, comprising:

a midsole comprising a midsole toe edge;

at least part of a remove-ably attachable outsole comprising an outsole toe edge, and an outsole toe ridge;

the outsole toe ridge extends vertically to an outsole toe ridge height; and the outsole toe ridge extends along at least part of the outsole toe edge;

wherein the midsole toe edge and the outsole toe ridge limit movement between the at least part of a remove-ably attachable outsole and the midsole in at least one direction;

wherein at least a portion of said outsole toe edge extends along a width of an upper surface of said remove-ably attachable outsole at said outsole toe ridge;

the midsole further comprising a midsole fastener area;

the at least part of a remove-ably attachable outsole further comprises an outsole fastener area;

wherein the midsole fastener area and the outsole fastener area comprises a hook and pile fastener system; and at least one of the midsole fastener area and the outsole fastener area further comprises a consecutive series of gaps that interrupt the hook and pile fastener system.

2. The sole of claim 1, further comprising:

the midsole further comprising a midsole recess above the midsole toe edge;

the midsole recess extending along at least part of the midsole toe edge;

the at least part of the remove-ably attachable outsole further comprising an outsole shelf extending along at least part of the outsole toe ridge;

wherein the outsole shelf terminates inside the midsole recess when the at least part of the remove-ably attachable outsole is attached to the midsole.

3. The sole of claim 1, further comprising:

wherein both of the midsole fastener area and the outsole fastener area comprise a consecutive series of gaps;

wherein at least one of the midsole fastener area gaps and the outsole fastener area gaps further comprises a groove;

wherein at least one of the midsole fastener area and the outsole fastener area further comprises a protrusion, wherein the groove receives the protrusion.

4. The sole of claim 1, further comprising:

wherein the gaps extend laterally from a left side to a right side with respect to the midsole.

5. The sole of claim 1, further comprising:

wherein the gaps each have a width that extends longitudinally a distance from a leading edge to a trailing edge.

6. A sole of a shoe, comprising:

a midsole further comprising a midsole toe edge;

wherein the midsole toe edge and an outsole toe ridge limit movement between at least part of a remove-ably attachable outsole toe portion and the midsole in at least one direction;

wherein at least a portion of said midsole toe edge and a portion of said outsole toe ridge abut each other to form a seam; and a remove-ably attachable outsole heel portion, said outsole heel portion being separate and distinct from said remove-ably attachable outsole toe portion;

the midsole further comprising a midsole fastener area;

the at least part of a remove-ably attachable outsole toe portion further comprises an outsole fastener area;

wherein the midsole fastener area and the outsole fastener area comprises a hook and pile fastener system; and at least one of the midsole fastener area and the outsole fastener area further comprises a consecutive series of gaps that interrupt the hook and pile fastener system.

7. The sole of claim 6, further comprising:

the midsole further comprising a midsole recess located above the midsole toe edge that extends along at least part of the midsole toe edge;

wherein the midsole recess and an outsole shelf limit movement between the at least part of the remove-ably attachable outsole toe portion and the midsole in at least one direction.

8. The sole of claim 7, further comprising:

the midsole further comprising a midsole fastener area with a midsole fastener area gap.

9. The sole of claim 7, further comprising:

the midsole fastener area further comprising a midsole fastener area gap;

the midsole fastener area gap further comprising a groove;

wherein the midsole groove and an outsole protrusion limit movement between the at least part of the remove-ably attachable outsole toe portion and the midsole in at least one direction.

10. The sole of claim 7, further comprising:

a midsole fastener area gap extending laterally from a left side of the midsole to a right side of the midsole.

11. The sole of claim 7, further comprising:

a finger channel on the midsole.

12. A sole of a shoe, comprising:

at least part of a remove-ably attachable outsole further comprising an outsole toe edge and an outsole toe ridge; wherein said at least part of the remove-ably attachable outsole terminates at an edge opposite said outsole toe edge;

the outsole toe ridge extending vertically to an outsole toe ridge height;

the outsole toe ridge extending along at least part of the outsole toe edge;

wherein the outsole toe ridge and a midsole toe edge limit movement between the at least part of the remove-ably attachable outsole and a midsole in at least one direction;

said midsole further comprises a cavity extending a height axially into said midsole;

said outsole further comprises a consecutive series of gaps that interrupt a hook and pile fastener system and extend laterally across a bottom surface of said outsole;

wherein said outsole terminating edge is approximately adjacent at least a portion of said cavity when said at least part of the remove-ably attachable outsole is secured to said midsole.

13. The sole of claim 12, further comprising:

an outsole shelf extending along at least part of the outsole toe ridge;

wherein the outsole shelf and a midsole recess limit movement between the at least part of the remove-ably attachable outsole and the midsole in at least one direction.

14. The sole of claim 12, further comprising:

the consecutive series of gaps comprises at least one protrusion.

15. The sole of claim 12, further comprising:

the consecutive series of gaps further comprises at least one outsole protrusion;

wherein the outsole protrusion and a midsole groove limit movement between the at least part of the remove-ably attachable outsole and the midsole in at least one direction.

16. The sole of claim 12, further comprising:

the gaps extend laterally from a left side of the at least part of a remove-ably attachable outsole to a right side of the at least part of a remove-ably attachable outsole.

17. The sole of claim 3, further comprising:

wherein when the groove accepts the protrusion they form a flexible joint that limits shear stress on the fastener areas caused by bending of the shoe, and wherein the groove and protrusion are allowed to flex independently as the shoe bends.

18. The sole of claim 6, further comprising:

wherein the consecutive series of gaps that interrupt the hook and pile fastener system further comprise a consecutive series of grooves that accept a consecutive series of protrusions.

19. The sole of claim 18, further comprising:

wherein when the grooves accept the protrusions they form a flexible joint that limits shear stress on the fastener areas caused by bending of the shoe, and wherein the groove and protrusion are allowed to flex independently as the shoe bends.

20. The sole of claim 12, further comprising:

wherein the consecutive series of gaps that interrupt the hook and pile fastener system further comprise a flexible joint that limits shear stress on the hook and pile fastener system caused by bending of the shoe.

* * * * *